US006009808A

United States Patent [19]

Löffler

[11] Patent Number: 6,009,808

[45] Date of Patent: Jan. 4, 2000

[54] METHOD OF MULTICOLOR PRINTING INVOLVING MULTIPLE PASSES THROUGH A PRINTING MACHINE

[75] Inventor: Gerhard Löffler, Walldorf, Germany

[73] Assignee: Heidelberger Druckmaschinen AG, Heidelberg, Germany

[21] Appl. No.: 08/384,847

[22] Filed: Feb. 7, 1995

[30] Foreign Application Priority Data

Feb. 8, 1994 [DE] Germany ..... 44 03 861

[51] Int. Cl.[7] ..... B41M 1/14; B41F 5/16; B41F 1/34

[52] U.S. Cl. ..... 101/211; 101/174; 101/183; 101/171; 101/485

[58] Field of Search ..... 101/181, 182, 101/485, 486, 484, 171, 174, 183, 211

[56] References Cited

U.S. PATENT DOCUMENTS

| | | | |
|---|---|---|---|
| 3,051,841 | 8/1962 | Crosfield et al. . | |
| 4,403,874 | 9/1983 | Payne et al. . | |
| 4,448,121 | 5/1984 | Uno et al. . | |
| 4,994,975 | 2/1991 | Minschart | 364/469 |
| 5,142,139 | 8/1992 | Hayashi et al. . | |
| 5,181,257 | 1/1993 | Steiner et al. | 250/559 X |
| 5,412,577 | 5/1995 | Sainio | 364/469 |

FOREIGN PATENT DOCUMENTS

| | | |
|---|---|---|
| 0 105 468 | 9/1983 | European Pat. Off. . |
| 62-119040 | 5/1987 | Japan . |
| 4-173150 | 6/1992 | Japan . |
| 4-353479 | 12/1992 | Japan . |
| 4-355158 | 12/1992 | Japan . |
| 2 165 801 | 11/1984 | United Kingdom . |

*Primary Examiner*—Kimberly L. Asher
*Attorney, Agent, or Firm*—Herbert L. Lerner; Laurence A. Greenberg

[57] ABSTRACT

A method for multicolor printing, wherein stored information from the surface of a printing material obtained from an earlier pass of the printing material is applied to subsequent passes of the printing material through the printing machine, and wherein the image signals obtained by means of an image pickup device from at least one surface of the printed material are stored in a steering-or control device, and wherein the stored image signals are applied to subsequent passes of the printed material through the printing machine. The invention can be applied to other devices for producing printed images.

2 Claims, 2 Drawing Sheets

METHOD OF MULTICOLOR PRINTING INVOLVING MULTIPLE PASSES THROUGH A PRINTING MACHINE

BACKGROUND OF THE INVENTION

FIELD OF THE INVENTION

The invention relates to a multicolor printing method wherein a printed image on a printed material is attained with at least two passes.

In the known multicolor printing of this art it is necessary to set the register devices such that the process is allowed to proceed so that the register and other adjustments affecting the printing quality in a second pass are adjusted to insure that the second printed image is in registration and in all other respects matches the first printed image.

The matching is actually difficult and time consuming, since usually only few adjusting parameters from the first pass are saved, and therefore available for the following pass. As an example the storing and reuse of ink zone adjustments combined with job data on magnetic tape or on a diskette, may be mentioned.

In order to attain precise registration in a second or later passes, there are usually only register marks and printing control strips to watch, while deviations that are present in the printed image are not considered, which may lead to quality losses.

It is also known to inspect the entire surface of a printed material. The measuring signals from inspection devices are accordingly used only to influence the printing operation during the actual pass through the printing machine.

SUMMARY OF THE INVENTION

It is the object of the invention to provide a method for multicolor printing wherein stored information obtained from the surface of the printed material in earlier passes through the printing machine is used to influence the operation during subsequent passes.

It is another object of the invention to use, in a method for multicolor printing, information obtained from the surface of the printed material during earlier passes in subsequent passes through the machine.

According to the invention, the solution to overcome the aforesaid problems and to attain the aforesaid object of the invention, is to store image signals obtained from at least one surface of the printed material in a steering-or control device, and to apply the stored image signals to the steering-or control of the printing operations in subsequent passes of the print through the printing machine. The invention makes it possible to influence, by means of image signals obtained from preceding passes, the adjustments of adjusting devices the inking of the surface of the printed material, so that to that end, subsequent passes are performed with high speed and high accuracy. Since the image signals for adjusting the image are taken from the entire surface of the printed material, the adjustments can be optimized for any desired areas of the image motive, which insures a high printing quality.

An especially high printing quality may be attained if ink measuring values are obtained from defined measuring areas of the image surface and stored, and are used by steering or control of the printing process in subsequent passes.

According to the invention, a method is provided for multi-color printing of a printed image on printed material in at least two passes through a printing machine, the printing machine having at least one image pickup device for generating image signals from at least one surface of the printed material, and a steering-or control device for steering-or controlling the method steps acting on the image forming process, the method which comprises:

storing in the steering-or control device image signals picked up by the image pickup device in a first pass of the printed material through the printing machine, and applying the stored image signals from the first pass to the steering or control process in subsequent passes of the printed material through the printing machine.

A method for multicolor printing of a printed image on printed material in at least two passes through a printing machine, the printing machine having at least one image pickup device for generating image signals from at least one surface of the printed material, and a steering-or control device for steering or controlling the method steps acting on the image forming process, the method which comprises:

obtaining from the image signals ink coverage values from defined measuring areas on the surface of the printed material;

storing the image signals in the steering-or control device; and applying the stored ink coverage values to process steps of at least one subsequent pass of the printed material through the printing machine.

Other features which are considered as characteristic for the invention are set forth in the following description:

Although the invention is illustrated and described herein as embodied in a method for multicolor printing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

The following is a more detailed description of an exemplary embodiment of the invention.

Figure 1:
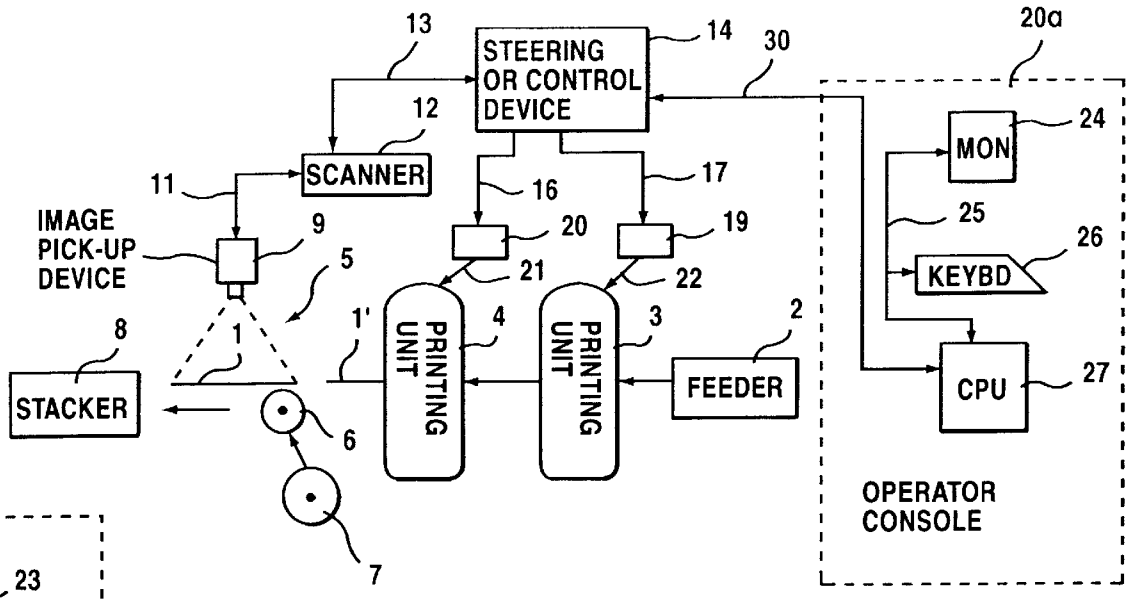
FIG. 1 is a block diagram of a printing machine according to the invention.

The machine according to FIG. 1 is arranged to produce four color prints in two passes by means of a two color printing machine. As the printing machine is connected with a steering-or control device for controlling the inking, the ink-adjusting elements and the dampening-adjusting elements are pre-adjusted in accordance with available data. After start of the printing machine the ink-adjusting elements and the dampening-adjusting elements are adjusted so that the continuous printing state is attained as soon as possible.

FIG. 1 is a block diagram of an exemplary printing machine as contemplated for performing the method according to the invention. The printing machine is composed of feeder 2 for feeding printing material into a printing machine having a first printing unit 3, and a second printing unit 4 followed by an image pickup station 5, and a sheet stacker 8. The feeder 2 feeds printing material, e.g. in the form of sheets 1 or a paper web or the like through the printing machine by means of a conveying arrangement, not shown in detail, since such arrangements are conventional and well known, but symbolized by a conveying roller 6 driven by a motor 7, which may be the drive motor for the entire printing machine.

A partially printed sheet 1' is emerging from the last printing unit 4 following a sheet 1 in the image pickup station 5. The image pickup station 5 includes an image pickup device 9, which scans the partially printed image and forms on the basis of the scan an electronic image on its internal image screen, in a manner well known from image scanning devices, as used, for example, in video recorders and the like. The image pickup device 9 is connected via data lead 11 to a scanner control circuit 12, which controls the scanning beam in the pickup device 9, and transmits the image details of the printed image, including the edges of the printed material and the edges of the image, and any control and/or register marks that may be printed on the margins of the printed sheet in well known manner. The image information is transmitted to a steering and control device 14 via a data line 13. As a result of the scanning the steering-or control device 14 contains all color information embedded in the particular printed image and also the precise position information of the printed two color image as it is positioned on the sheets or web in relation to the edges of the sheet or web, including register marks and/or color test marks.

During a first partial printing with, for example, two first color inks F1 and F2, the steering-or control device 14 monitors the precise position information from the first printed sheet, and adjusts the position of each subsequent sheet so that its position is precisely aligned with the first sheet, in other words, so that all sheets are in perfect register. Registration is performed by means of two conventional register controls 20, 19 that each controls a respective printing unit 4 and 3 via respective control lines 21, 22. It should be understood that position information is determined for each color printed in the respective printing units 3 and 4. To that end the electronic image color information presented to the steering-or control device 14 is dissolved into its spectral components by well-known electronic imaging means, wherein the image position information is separated into the respective ink colors of the partially printed image. The steering-or control device 14 responds to the position information for the two images in colors F1 and F2, and operates on register control devices 20, 19 so that the two color images from printing units 3 and 4 are maintained in precise registration during the entire first printing run.

In a second pass all partially printed sheets are moved from stacker 8 to sheet feeder 2 to be printed with colors F3 and F4 in a second pass. As in the first pass each printed sheet again passes through the image pickup station 5 and again the printed image for colors F3 and F4 is dissolved into their respective spectral components and the position information for each image is determined. If the position information for colors F3 and F4 deviates from that of the first printed images in colors F1 and F2, the differences in position information is determined by steering- or control device 14 and is transmitted to register controls 20, 19 via data leads 16 and 17, which operate to move the images of colors F3, F4 into the precise positions stored in the steering-or control device 14 of the previously printed images in colors F1 and F2, the position information of which was retained in memory in the steering-or control device 14.

Figure 2:
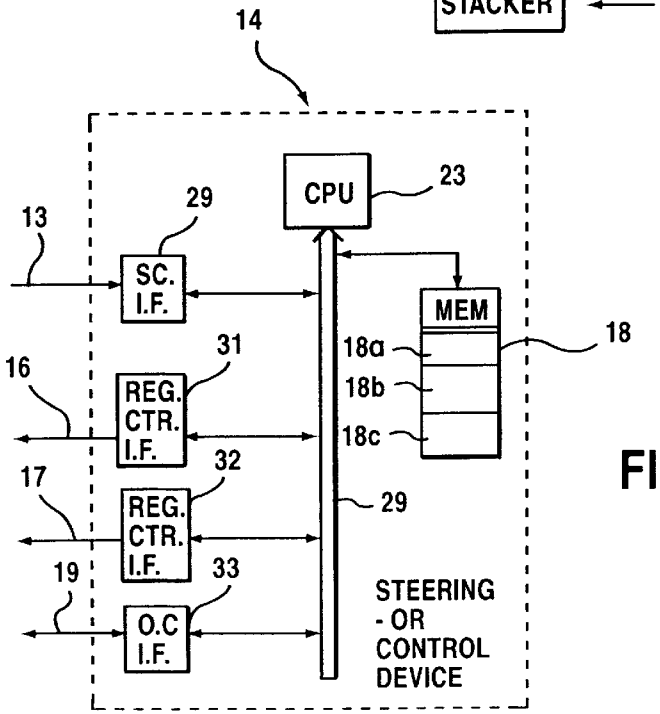
FIG. 2 is a block diagram of a control system for the steering-and control device for the printing machine.

FIG. 2 is a block diagram of the steering-or control device 14, which is advantageously structured as an electronic computer. As such structured the steering-or control circuit 14 has a central processing unit CPU of conventional construction, such as, for example, a CPU circuit known as a 40 386 circuit from Intel Corporation or a M6800 circuit from Motorala Corporation. These circuits are well known and documented in application information available from aforesaid firms. In FIG. 2, the CPU 23 is connected via a data bus 29 to a memory circuit 18, which includes memory section 18*a*, which holds operating programs as required for the CPU 28 to perform the functions described above, section 18*b* which holds data information such as image position and color data for each color F1, F2, F3 and F4, and section 18*c*, which holds the computational program instructions for performing position and color correction programs, and other programs as required for processing position and color information received from scanner circuit 12.

The steering-or control circuit 14 further includes interface circuits 29 for interfacing with scanner 12 via data line 13, interface circuit 31 for interfacing via data line 16 with register control 20 for printing unit 4, interface 32 for interfacing with register control 19 for printing unit 3 via data line 17, and an operator console interface 33 for an operator system 20*a*.

The operator system 20*a* is structured as a conventional work station computer PC 27 combined with a monitor display 24, a keyboard 26, and a CPU 27. The CPU 27 is connected with the steering-or control circuit 14 via a data bus, e.g. in the form of a conventional LAN (Local Area Network) bus 30, and the components of the work station 20 are interconnected by an internal data bus 25.

Figure 3:
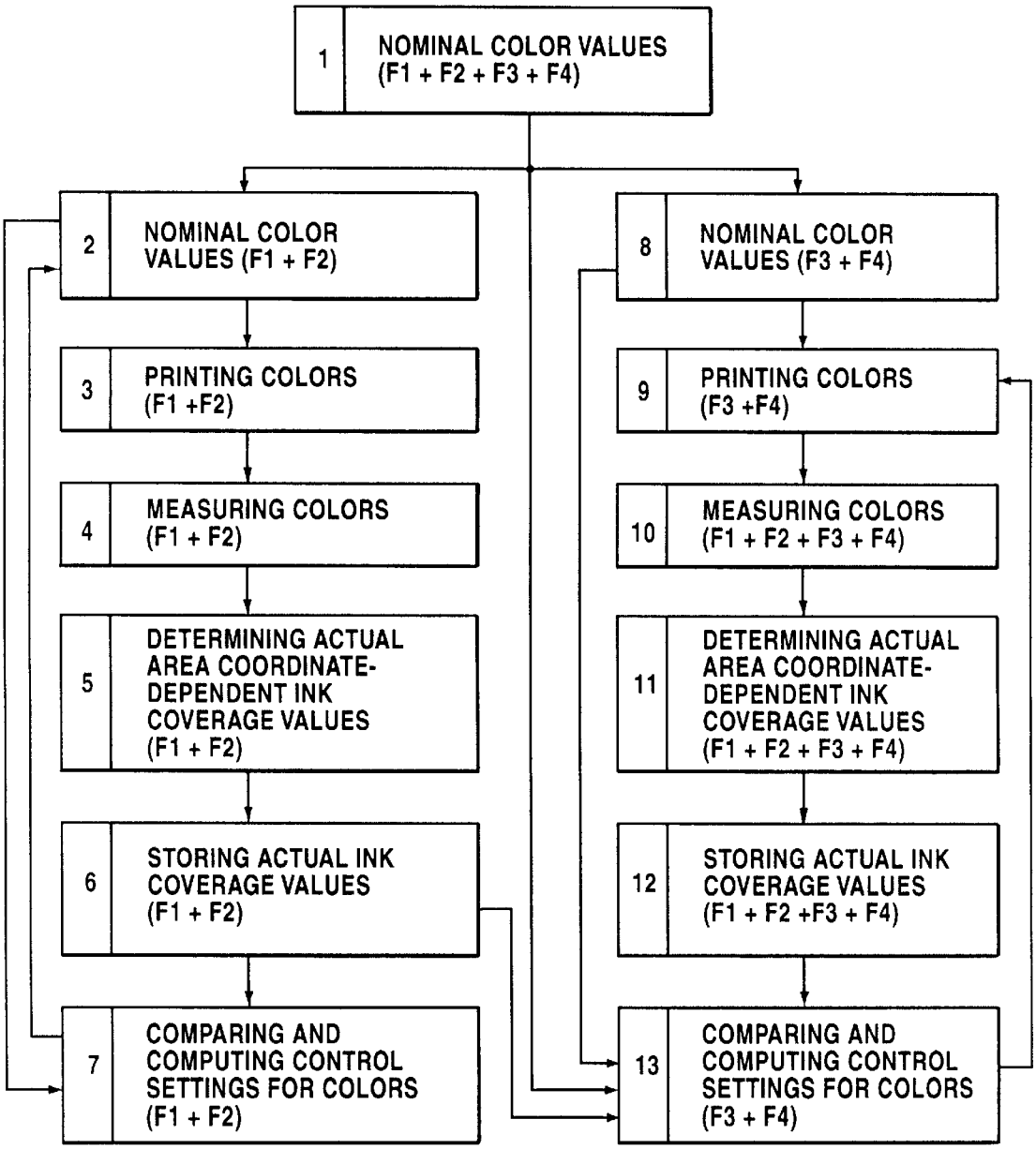
FIG. 3 is a flow-chart showing the major steps of the method of the invention.

The functions of setting the ink controls of the printing machine are shown in the flowchart of FIG. 3.

As seen from the flowchart of FIG. 3 in the first step 1 the ink-adjusting elements and the dampening-adjusting elements, are set to area coordinate-dependent nominal values for the four ink colors (F1+F2+F3+F4) to be printed on atop of each other, and stored as ink coverage values in the steering-or control device 14 to be used as beginning values. The plus signs between the color capital letters are to be understood to mean the four-colors are to be printed in registration on top of each other.

From these nominal values the nominal values for the colors (F1+F2) to be printed in the first pass are selected, as shown in step 2. In step 3 two-color prints are produced in printing units 3 and 4, and a printed sheet appears at the exit of the second printing unit 4. Next the sheet with colors F1, F2 is scanned and measured by means of an image pickup device in step 4, as measured ink coverage values for ink colors F1+F2. In step 5, from the ink coverage values in the image, actual area coordinate-dependent ink coverage values are determined.

In step 6 the actual area coordinate-dependent ink coverage values determined in step 5 are stored as actual values in the steering-or control device 14. In step 7 the stored actual values are compared with the nominal values in step 2 and control settings for the respective ink-adjusting elements and the difference between the actual and nominal values for the dampening-adjusting elements are computed in the steering-or control device 14 as settings. These settings are forwarded to the respective ink-adjusting elements and dampening-adjusting elements, resulting i the operation shown in step 3, namely the printing of colors F1 and F2.

The printing in the second pass of colors (F3+F4) proceeds from step 1, in similar manner as shown above for colors F1 and F2. In step 8 nominal values for colors F3 and F4, to be printed, are selected from the nominal values for colors (F1+F2+F3+F4) in step 1. In next step 9, the sheet is again printed in a second pass with the nominal colors (F3+F4). In next step 10 the sheet is again inspected and scanned by means of the above described image pickup device 9. In step 11 the image signals from the image pickup device are analyzed to determine the actual area coordinate-dependent ink coverage values for colors (F1+F2+F3+F4). These values are stored, as in the first pass, in step 12 as actual ink coverage values. In step 13, in the steering-or control device the stored actual values from steps 6 and 12 are compared with the stored nominal values from steps 1 and 8, and setting values for the ink-adjusting elements and for the dampening-adjusting elements are computed and used for printing the sheet in step 9. In the computation for the setting values for the second pass only the differences from the ink coverage values for the first pass are used.

In addition to the color printing steps according to FIG. 3, in the first pass image position information is determined by the steering- or control device 14 from the image information attained with the image pickup device. Any position deviation between images F1, F2 is computed by the steering- or control device 14. In case of deviations, the images F1, F2 are position adjusted so as to be in perfect registration, and the corresponding position information is stored in memory 18 in the image position section 18*b*. In the second pass, when the first sheet 1 appears in the image pickup station, the printed image is again dissolved into its spectral components colors, and the position information for colors F3, F4 is determined as before for colors F1, F2. If any position deviation is determined, the deviations are transmitted to register controls 20, and 19, which operate to reset the registers such as to eliminate the deviations, and the next printed sheets will emerge printed in perfect registration. During each pass the image pickup device with the scanner 12 and the steering- or control device 14 continues to monitor each image for proper registrations, and in case the register deviations occur during the printing corrections are quickly implemented or a machine operator is alerted by means of the operator console 20, so that correction can be made manually by the operator.

In order to facilitate determination of the position information for each color, it is advantageously provided that register marks in all printing colors are printed on the printed sheets outside the image area. The register marks are advantageously printed in different colors, and are spatially separated by colors on the sheet.

I claim:

1. A method for multicolor printing of a printed image on printed material in at least two passes through a printing machine, the printing machine having at least one image pickup device for generating image signals from at least one surface of the printed material, and a steering or control device for steering-or controlling method steps acting on an image forming process, the method which comprises:

storing in the steering-or control device image signals picked up by the image pickup device in a first pass of the printed material through the printing machine, and applying the stored image signals from the first pass to the steering or control device in subsequent passes of the printed material through the printing machine.

2. A method for multicolor printing of a printed image on printed material in a first pass and a subsequent pass through a printing machine, the printing machine having an image pickup device for generating image signals from a surface of the printed material, and a steering-or control device for steering or controlling method steps acting on an image forming process, the method which comprises:

generating image signals from a surface of a printed material by an image pickup device in a first pass of the printed material through a printing machine;

obtaining from the image signals ink coverage values from defined measuring areas on the surface of the printed material;

storing the ink coverage values in a steering-or control device; and applying the stored ink coverage values to process steps of a subsequent pass of the printed material through the printing machine.

* * * * *